US008850615B2

(12) United States Patent
Demarest et al.

(10) Patent No.: US 8,850,615 B2
(45) Date of Patent: Oct. 7, 2014

(54) THERMAL ENERGY DISSIPATING GARMENT WITH SCALLOPED VENTS

(75) Inventors: Nathan Demarest, Portland, OR (US); Alexander J. Dedman, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1125 days.

(21) Appl. No.: 12/796,336

(22) Filed: Jun. 8, 2010

(65) Prior Publication Data

US 2011/0296580 A1 Dec. 8, 2011

(51) Int. Cl.
*A41D 27/08* (2006.01)
*A41D 27/28* (2006.01)

(52) U.S. Cl.
CPC ... *A41D 27/28* (2013.01); *Y10S 2/01* (2013.01)
USPC ..... 2/69; 2/DIG. 1

(58) Field of Classification Search
USPC ..... 2/69, 69.5, 85, 87, 93, 94, 79, 272, 2/DIG. 1
See application file for complete search history.

(56) References Cited

U.S. PATENT DOCUMENTS 2,342,569 A * 2/1944 Bernstein ..... 112/475.15
3,369,303 A * 2/1968 Henry ..... 33/563
3,950,789 A * 4/1976 Konz et al. ..... 2/93
4,425,391 A * 1/1984 Wilson ..... 428/43
4,608,715 A * 9/1986 Miller et al. ..... 2/1
4,722,099 A * 2/1988 Kratz ..... 2/79
5,303,424 A * 4/1994 Cromartie ..... 2/67
5,379,615 A * 1/1995 Shima ..... 66/176
5,638,145 A * 6/1997 Jannard et al. ..... 351/62
5,704,064 A * 1/1998 van der Sleesen ..... 2/69
6,263,511 B1 * 7/2001 Moretti ..... 2/97
6,499,513 B1 * 12/2002 Couch ..... 112/470.03
6,868,557 B1 * 3/2005 van der Sleesen ..... 2/93
7,169,249 B1 * 1/2007 Nordstrom ..... 156/256
8,312,826 B2 * 11/2012 Lafferty et al. ..... 112/475.01
2004/0237168 A1 * 12/2004 Braun ..... 2/93
2006/0282940 A1 * 12/2006 Martini et al. ..... 2/455
2007/0157369 A1 * 7/2007 Uchibori et al. ..... 2/255
2008/0263743 A1 * 10/2008 Maurer ..... 2/69
2009/0077710 A1 * 3/2009 Bay ..... 2/87

* cited by examiner

*Primary Examiner* — Danny Worrell
(74) *Attorney, Agent, or Firm* — Shook, Hardy & Bacon L.L.P.

(57) ABSTRACT

A thermal energy dissipating garment may include a first garment portion having a perimeter defined by at least a first side and a second garment portion having a perimeter defined by at least a vent side. The first garment portion and the second garment portion are discontinuously affixed to each other at defined intervals along a surface of each portion proximate to the first side and the vent side creating a vent seam having a plurality of ducts/scalloped vents for directing air towards a body of a wearer. The plurality of scalloped vents are oriented with an angle of attack that redirects air from the exterior of the garment to the interior of the garment to increase air movement along a wearer's skin.

19 Claims, 6 Drawing Sheets

THERMAL ENERGY DISSIPATING GARMENT WITH SCALLOPED VENTS

BACKGROUND

A challenge faced by an athlete when competing and training, particularly in moderate to hot temperature conditions, is thermal energy dissipation (i.e., heat transfer). An athlete may generate substantial thermal energy as a result of physical activity. In an effort to counteract the generation of heat, the body relies on a mechanism based on evaporative cooling. Generally, when a body's core temperature rises to a certain level, the body will begin to sweat. When liquid sweat evaporates in ambient air surrounding or passing the body, the physical conversion of the liquid to a corresponding gas form (i.e., drying process) draws heat from the body. In this case, sweating cools an athlete due to an evaporative cooling effect as the sweat dries.

Evaporation of sweat is dependent on the water vapor pressure (e.g., relative humidity) of air in contact with the athlete's skin. Consequently, air movement along the athlete's skin is also an import factor in dissipating thermal energy from the athlete. For example, ambient air gains humidity as it picks up moisture during the evaporation of sweat. In the absence of adequate air movement (e.g., exchange of air along the skin), this humidified air becomes less effective at dissipating heat as it is trapped in areas surrounding the skin. As a result, reduced or minimized airflow along the skin's surface inhibits the cooling provided by continued evaporation of sweat.

SUMMARY

Embodiments of the present invention relate to a garment effective to dissipate thermal energy from a wearer's body. An exemplary embodiment of a garment for dissipating thermal energy incorporates a first garment portion having a perimeter defined by at least a first side and a second garment portion having a perimeter defined by at least a vent side. The first garment portion and the second garment portion are permanently and discontinuously affixed to each other at defined intervals proximate to the first side and the vent side creating a vent seam having a plurality of scalloped vents/ducts for directing air towards a body of a wearer.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 2:
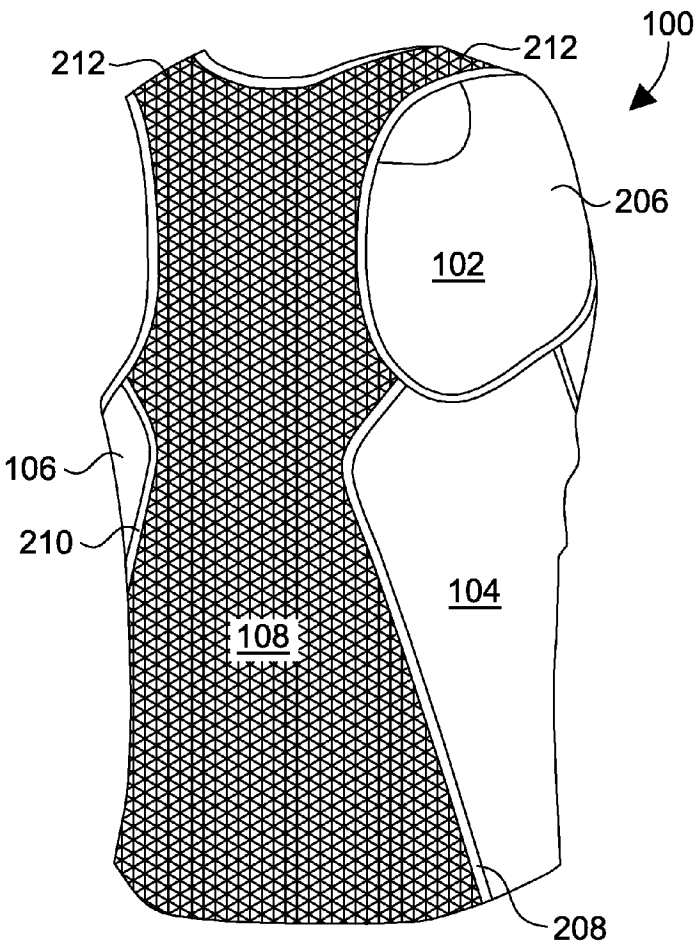
FIG. 2 depicts an exemplary garment back perspective in accordance with embodiments of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

Accordingly, in one aspect, the present invention provides an exemplary embodiment of a garment for dissipating thermal energy incorporates a first garment portion having a perimeter defined by at least a first side and a second garment portion having a perimeter defined by at least a vent side. The first garment portion and the second garment portion are permanently and discontinuously affixed to each other at defined intervals proximate to the first side and the vent side creating a vent seam having a plurality of scalloped vents for directing air towards a body of a wearer.

In another aspect, the present invention provides a garment with an anterior panel having an exterior surface, an opposite interior surface, and a perimeter including an anterior vent edge. The garment also incorporates a lateral panel having an exterior surface, an opposite interior surface, and a perimeter including a lateral vent edge. Further, the garment incorporates a scallop vent seam defined by affixing, at discontinuous points, the anterior panel and the lateral panel together proximate to the anterior vent edge and the lateral vent edge, wherein the scallop vent seam provides a plurality of scalloped vents that extend away from a plane defined by the anterior panel and the lateral panel.

A third aspect of the present invention provides a thermal energy moderating garment. The garment incorporates a front panel comprised of an exterior surface, an interior surface, and perimeter defined by at least a front right lateral edge and a front left lateral edge. The garment also incorporates a back panel comprised of an exterior surface, an interior surface, and a perimeter defined by at least a back right lateral edge and a back left lateral edge, wherein the back panel incorporates a plurality of opening through the parallel exterior surface and the interior surface. The garment further incorporates a right lateral panel comprised of an exterior surface, an interior surface, and a perimeter defined by at least a right vent edge and a right back edge. The garment also incorporates a left lateral panel comprised of an exterior surface, an interior surface, and a perimeter defined by at least a left vent edge and a left back edge. Additionally, the front panel, proximate to the front right lateral edge, is joined at a series of discontinuous locations to the right lateral panel, proximate to the right vent edge, resulting in a right scalloped vent seam. The right scalloped vent seam is comprised of a plurality of scalloped vents extending away from the body of a wearer of the thermal energy moderating garment. The front panel, proximate to the front left lateral edge, is joined at a series of discontinuous locations to the left lateral panel, proximate to the left vent edge, resulting in a left scalloped vent seam. The left scalloped vent seam is comprised of a plurality of scalloped vents extending away from the body of the wearer of the thermal energy moderating garment. Further, the back panel, proximate to the back right lateral edge, is joined to the right lateral panel, proximate to the right back edge. Additionally, the back panel, proximate to the back left lateral edge, is joined to the left lateral panel, proximate to the left back edge.

Figure 1:
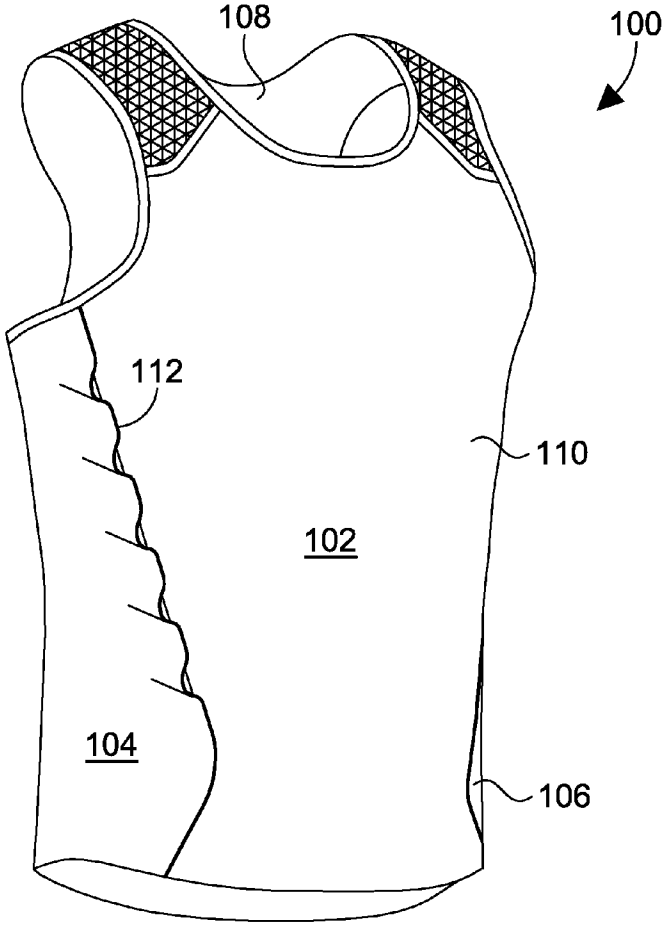
FIG. 1 depicts an exemplary garment front perspective in accordance with embodiments of the present invention.

Referring to the drawings in general, and initially to FIG. 1 in particular, an exemplary garment 100 is illustrated with a front view in accordance with an embodiment of the present invention. The garment 100, while illustrated as a shirt like piece of apparel, it is understood that the present invention is not limited to the shape, dimensions, or even articles of apparel illustrated herein. Instead, a "garment" as used herein is contemplated to include, but not be limited to, articles of clothing worn over/on a portion of the body. For example, a garment may include a shirt having long sleeves or short sleeves, a tank top, a jersey, a coat, an inner layer, an outer layer, pants, shorts, leggings, tights, suites, gloves, hats, socks, protective gear, and the like. Further, it is contemplated that a scalloped vent is located along a seam relative to a wearer at a number of locations. For example, a scalloped vent seam (i.e., seam having one or more ducts) may be located anywhere on a wearer and at any orientation. Therefore, it is contemplated that a scalloped vent is located along a foot, leg, torso, arm, hand, head, back, stomach, or the like in various embodiments.

In an exemplary embodiment of the present invention, a garment is a singlet worn by longer distance runners, such as a marathon runner, where rules of the athletic activity require at least a portion of an athlete to be covered, such as the chest and upper torso. For example, a governing body of a particular sport may require athletes to where a singlet of a minimum size in order for the athlete to be identifiable, such as by a number attached to the singlet.

In the above example, while a singlet is necessary for the athlete to wear, the athlete, for performance and comfort reasons, may prefer to increase air movement close to their skin to increase thermal energy dissipation. Consequently, while an athlete may desire to forgo the singlet all together to achieve greater thermal dissipation, a governing body may insist such a garment is worn. Therefore, it is desired, in an exemplary embodiment of the present invention, to increase thermal energy dissipation by increasing air movement between the athlete's body and the garment worn by the athlete by introducing scalloped vents.

For example, as illustrated in FIG. 1, the garment 100 incorporates a front panel that is traditionally worn on the chest (i.e., anterior portion) of an athlete. As used herein, a panel is also referred to as a "portion." The garment 100 also incorporates a right lateral panel 104 that is traditionally worn on the right lateral section of an athlete. Further, the garment 100 incorporates a left lateral panel 106 that is traditionally worn on the left lateral section of an athlete. An exterior surface of the front panel 102, the right lateral panel 104, and the left lateral panel 106 is depicted in FIG. 1, but it is understood that an interior surface, closer to the body of the wearer, also exists for each of the panels. The garment 100 also incorporates a back panel 108 that is traditionally worn on the back (i.e., posterior portion) of an athlete. In this example, the interior surface of the back panel 108 is depicted, but an exterior surface, while not depicted in FIG. 1, is also present on the back panel 108.

The garment 100 also incorporates a scalloped vent seam 112. The scalloped vent seam 112, also referred to as a vent seam, is a seam at which two panels are joined. In an exemplary embodiment, the vent seam is a discontinuous joining of two panels. For example, a first panel may be joined to a second panel at discrete portions, but maintained separate from each other at other segments of the vent seam between the discrete joined portions. This is in contrast to a typical seam in which two panels are continuously joined by sewing, adhesive, or other bonding techniques along the length of the seam. Traditionally, two panels are continuously joined along a seam without discontinuous lapses/voids in the seam bonding to maximize adherence of the two panels as well as to protect a wearer from the elements, such as wind, precipitation, sun light, etc.

The vent seam 112, in an exemplary embodiment, differs from a typical seam that is constructed with a continuous bond (e.g., permanent or non-permanent) between two panels, as the garment 100 include a vent seam constructed from discontinuously affixing a first panel to a second panel at defined intervals. The segments of the vent seam for which the two panels are not affixed to one another creates a scallop vent or duct for directing air from the exterior surface of the garment 100 to the interior surface of the garment 100.

As will be discussed in greater detail hereinafter, a discontinuous affixation of two panels of the garment 100 results in portions or lengths along the vent seam 112 in which the two panels are free and able to move semi-independent from one another. Consequently, larger quantities of air are allowed to pass from the exterior of the garment 100 to the interior of the garment 100 as a result of the discontinuous affixation nature of the vent seam 112 compared to a traditional seam having continuous adhesion of the panels to one another.

In an exemplary embodiment, the volume of air allowed to move from the exterior to the interior of the garment 100 is increased by causing a "scalloping" effect to occur along the vent seam. Scalloped vents result from the puckering, gathering, or bunching of a portion of one panel as the one panel is affixed to another panel. A scalloped vent creates a duct for directing air in a general or particular direction. Therefore, as used herein, a scalloped vent is a duct. As will be illustrated in greater detail in FIGS. 3-9, a scalloped vent is a dimensional feature that increases a volume of air that may be directed from the exterior to the interior of the garment 100.

As used throughout, the term "affix" incorporates securing a first element to a second element. It is contemplated that a first element is affixed to a second element by way of adhesives, bonding agents, mechanical closures (e.g., snaps, buttons, zippers, hook and loop fasteners), stitching, sewing, lacing, and other well know techniques for binding two elements along a seam. Additionally, as used herein the joining and affixing of two elements, such as panels of a garment, contemplates a number of seam styles including, but not limited to, superimposed seam, lapped seam, bond seam, and flat seam. Therefore, when a front panel of a garment is affixed to a lateral panel of the garment along identified portions of each panels' perimeter, the manner in which the two panels are affixed contemplates a technique resulting in at least those seams discussed hereinabove. For example, the front panel may be overlapped by the lateral panel in order to ensure strength and durability of the resulting affixation of the two panels. In this example, both panels are still affixed along their respective sides.

It is contemplated that in an exemplary embodiment, the affixing of two panels is done "permanently." As used herein, permanently affixing includes an affixing technique that does not allow easy un-affixing of affixed elements. For example, stitching is but one example of a fastening technique that may be permanent. Conversely, snaps, buttons, zippers, hook-and-loop type fasteners, and the like are also contemplated as mechanisms for affixing two elements in a non-permanent manner. However, both permanent and non-permanent mechanisms are contemplated either alone or in combination within various exemplary embodiments.

Turning to FIG. 2 that depicts the exemplary garment 100 illustrated with a back view in accordance with an embodiment of the present invention. The garment 100, as previously discussed incorporates the right lateral panel 104 and the left lateral panel 106. Additionally, the garment 100 incorporates the back panel 108. FIG. 2 depicts the exterior surface of the back panel 108. Additionally, FIG. 2 depicts an interior surface 206 of the front panel 102.

In an exemplary embodiment a right edge of the front panel 102 is attached to an anterior edge of the right lateral panel 104 resulting in the vent seam 112. The right lateral panel 104 is additionally affixed, along a posterior edge, to the back panel 108 along a right edge resulting in a right lateral seam 208 along the segment of affixation. Further, the back panel 108, along a left edge, is affixed to the left lateral panel 106 along a posterior edge of the left lateral panel 106, resulting in a left lateral seam 210. Further, the left lateral panel 106, along an anterior edge, is affixed to the front panel 102 along a left edge, which results in a second vent seam.

Further, following the exemplary construction discussed immediately above, an inferior edge of each of the front panel 102, the right lateral panel 104, the back panel 108, and the left lateral panel 106 define a torso opening in which a torso of a wearer may extend.

Additionally, extensions 212 of the back panel 108 may extend along a superior edge of the back panel 108 that are affixed to a superior edge of the front panel 102. The affixation of the back panel 108 and the front panel 102 at a superior edge results, in this exemplary embodiment, in a plurality of openings suitable for a neck, a left arm, and a right arm of a wearer of the garment 100 to extend there from.

While the garment 100 is illustrated and described as including a back panel 108, a front panel 102, a left lateral panel 106, and a right lateral panel 104, any number of panels may be implemented to achieve the present invention. For example, a back panel may be affixed to a front panel along lateral portions to create one or more vent seams. Similarly, a left lateral panel, and a right lateral panel may be affixed to one another at an anterior portion eliminating the back panel. Consequently, while specific arrangements are discussed herein to aid in the understanding, it is contemplated that alternative arrangements, configurations, and styles are utilized. Additionally, as discussed previously, while an upper body covering garment is illustrated and described, similar features, techniques, and arrangements are contemplated for other apparel configuration (e.g., lower body apparel). Therefore, it is contemplated that a scalloped vent seam (ducts along a seam) may be incorporated into a variety of garment at a variety of locations on each of the garments (e.g., pants, shorts, shirts, hats, helmets, gloves, shoes, socks, under garments, outerwear, and suites).

Figure 3:
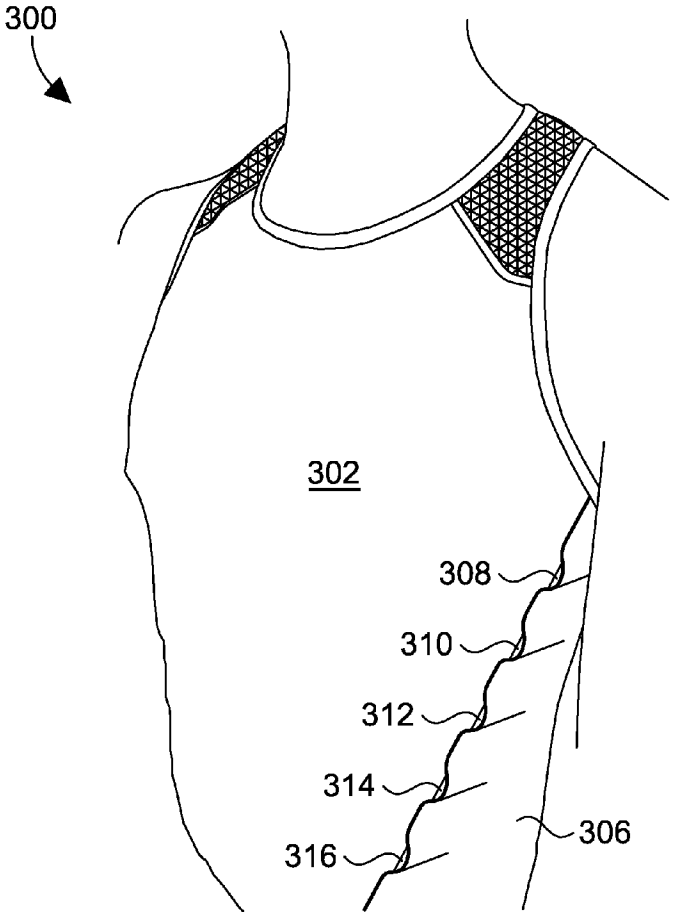
FIG. 3 depicts another garment in accordance with an embodiment of the present invention.

Turning to FIG. 3 that depicts a garment 300 in accordance with embodiments of the present invention. The garment 300 incorporates a front panel 302 and a left lateral panel 306. The front panel and the right panel are affixed to one another resulting in a vent seam comprised of a number of scalloped vents. The vent seam incorporates scalloped vents 308, 310, 312, 314, and 316. The vent seam extends from an anatomically superior point on a wearer that is between a posterior axillary line and an anterior axillary line to an inferior point that is more anterior than the starting point. As a result, the vent seam depicted in FIG. 3 angles from a lateral point closer to an arm opening of the garment 300 to a point more along the front of a wearer near a torso opening of the garment 300.

It is contemplated that a vent seam may parallel proximate to a midaxillary line of a wearer with a shift posterior or anterior depending on a number of factors (e.g., desired volume of air, chaffing, rubbing, aesthetics). Therefore, a vent seam is contemplated as having an angular presence to a near vertical presence relative to a superior/inferior axis of a wearer. As used herein, the term "proximate" may indicate a spatial relationship of elements. For example, element 'A' is proximate to element 'B' when element 'A' is close to, near to, next to, adjoining, and/or coinciding with element 'B.'

The scalloped vents 308, 310, 312, 314, and 316, as depicted in FIG. 3 are created from the left lateral panel 306 having additional length, prior to adhesion, relative to the front panel 302 proximate to the edges of adhesion. Therefore, the excess material of the left lateral panel 306 is apportioned in a systematic manner to result in a number of scalloped vents along the vent seam. Stated differently, excess length of the left lateral panel 306 is utilized to create each of the scalloped vents 308-316.

Each of the scalloped vents 308, 310, 312, 314, and 316 are a puckering, along a vent edge, of the left lateral panel 306. In an exemplary embodiment, a vent edge of a panel, which may be on any panel, is about 110%-120% the length of another panel's edge to which the vent edge will be adhered. For example, in order to create the scalloped vents 308, 310, 312, 314, and 316, the left lateral panel 306 may have a vent edge that is 112% the length of a left edge of the front panel 302. The additional material length of the left lateral panel 306 along a vent edge is apportioned in such as way as to provide the scalloping or puckering of the very material as a result of a discontinuous adhesion of the left lateral panel 306 and the front panel 302 along a vent seam.

Figure 4A:
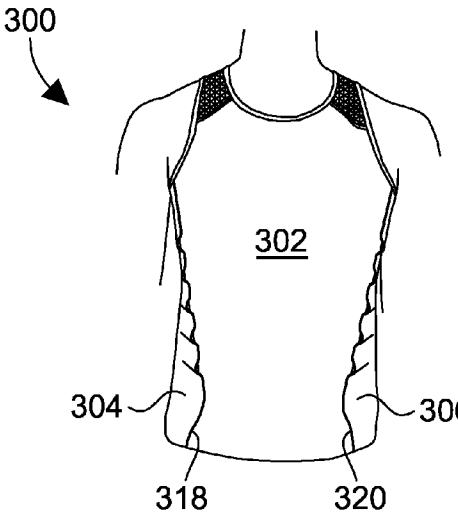
FIG. 4A depicts another garment front perspective in accordance with an embodiment of the present invention.

Turning to FIG. 4A depicting a frontal perspective, in accordance with an exemplary embodiment of the present invention, of the garment 300 previously discussed with respect to FIG. 3. FIG. 4A illustrates the front panel 302, the left lateral panel 306, and the right lateral panel 304. Additionally, FIG. 4A provides an illustration of a left vent seam 320 extending along a joining of the front panel 302 and the left lateral panel 306. FIG. 4A also illustrates a right vent seam 318 extending along a joining of the front panel 302 and the right lateral panel 304.

Figure 4B:
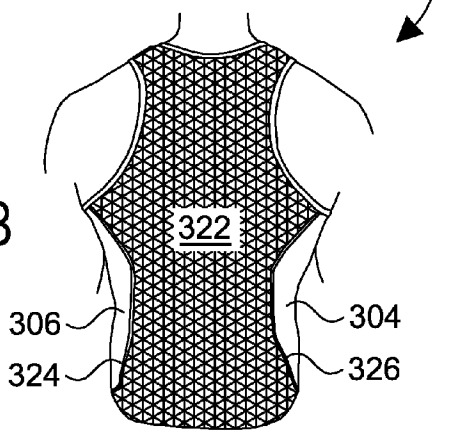
FIG. 4B depicts another garment back perspective in accordance with an embodiment of the present invention.

Turning to FIG. 4B depicting a back perspective, in accordance with an exemplary embodiment of the present invention, of the garment 300 previously discussed with respect to FIG. 3. FIG. 4B illustrates a back panel 322, the left lateral panel 306, and the right lateral panel 304. Additionally, FIG. 4B provides an illustration of a left posterior seam 324 extending along a joining of the back panel 322 and the left lateral panel 306. FIG. 4B also illustrates a right posterior seam 326 extending along a joining of the back panel 322 and the right lateral panel 304.

As previously discussed, the back panel 322 may be a material with a greater level of porosity than the front panel 302. For example, the back panel 322 may be created from a mesh (loose or tight knit) material to allow air that enters from the exterior of the garment 300 by way of the right vent seam 318 and the left vent seam 320 to pass along a torso of a wearer of the garment 300 and exit through the back panel 322. In an additional embodiment, the back panel 322 incorporates a series of openings (not shown) formed to allow a greater quantity and/or specific location of air to exit the interior of the garment 300. For example, one or more opening may be placed along the center line of the back panel 322 so that exiting air from the interior of the garment 300 would pass along the backside of a wearer before exiting proximate to a spinal axis of the wearer. Additional embodiments contemplate a series of opening positioned in a variety patterns to maximize airflow and a resulting thermal energy reduction.

Figure 5:
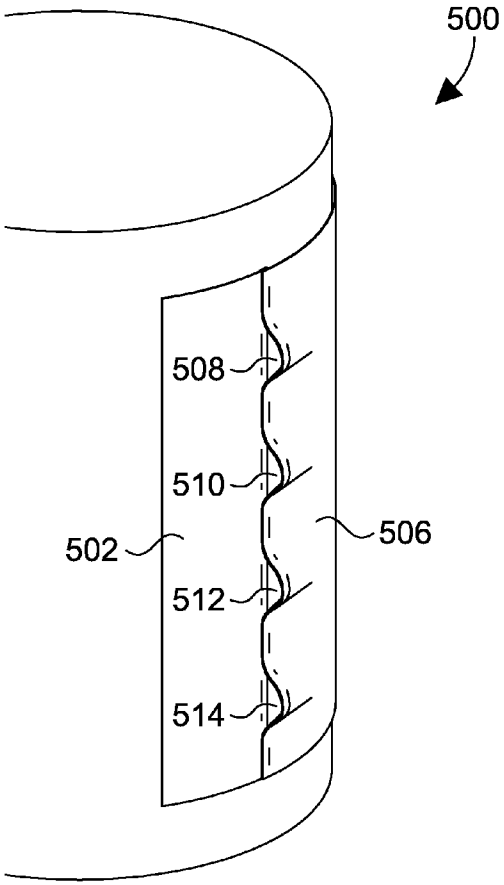
FIG. 5 depicts an exemplary vent seam having exterior scalloped vents in accordance with an embodiment of the present invention.

Turning to FIG. 5 depicting an exemplary embodiment of a vent seam 500 having exterior scalloped vents 508, 510, 512, and 514. In this exemplary embodiment, the vent seam 500 in created having a first panel 502 and a second panel 506. The second panel 506 is adhered to an exterior surface of the first panel 502. Additionally, the first panel 502 has an un-adhered length along the vent seam defined by scalloped vents 308-314 that is less than the un-adhered length of the second panel 506. Consequently, when the interior surface of the second panel 506 is adhered to the exterior surface of the first panel 502, an excess in material resulting from the additional pre-adherence length of the second panel 506 is bunched at defined portions causing the scalloped vents 508-514. Stated differently, the scalloped vents 508-514 extend outwardly from a plane defined by the first panel 502 and the second panel 506, such that the scalloped vents 508-514 are exterior scalloped vents. An exterior scalloped vent incorporates a panel having a greater pre-adherence length that is distal (farther away) to a wearer's body relative to a panel having a lesser pre-adherence length. This is in contrast to an interior scalloped vent that incorporates a panel having a greater pre-adherence length that is proximal (closer) to a wearer's body relative to a panel having a lesser pre-adherence length (e.g., as will be discussed with respect to FIG. 6).

In an exemplary embodiment, a scalloped vent opening is positioned to "scoop" or otherwise direct air movement from the exterior of a garment to an interior portion of the garment near the body of a wearer. In order to effectively "scoop" air, in an exemplary embodiment, the opening of a scalloped vent are oriented towards a predominant direction of air flow while being worn. For example, a scalloped vent for a running athlete may have an opening directed to the front of the athlete and approximately horizontal. This exemplary angle of attack for the scalloped vents allows a maximized volume of air to enter the scalloped vent while the wearer is running forward. Similarly, a road biker that is typically in a curled torso position while riding may have a scalloped vent located along the biker's back with a vent opening oriented to the superior of the wearer. In this example, as the biker/wearer is in a riding position, air movement flows over the athlete's head and down the athlete's back; therefore, a vent along the back having an opening oriented towards the head maximizes airflow redirection while in that riding position.

Figure 6:
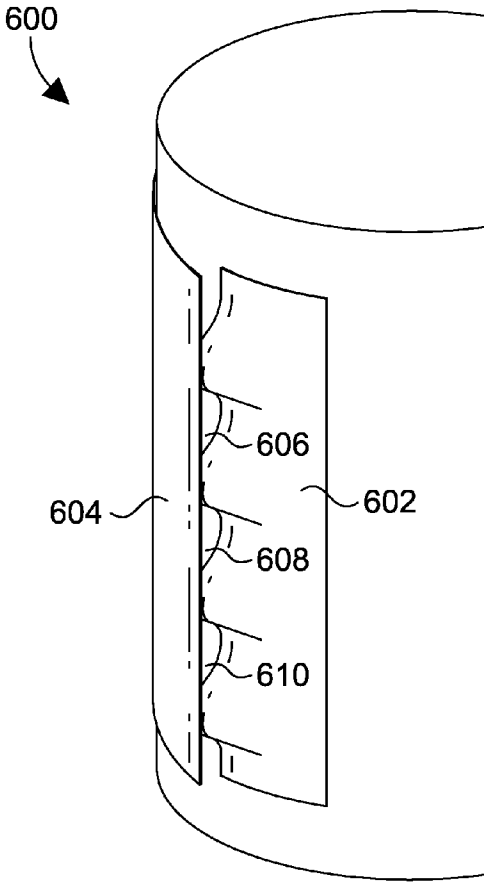
FIG. 6 depicts an exemplary vent seam having interior scalloped vents in accordance with an embodiment of the present invention.

Turning to FIG. 6 illustrating an exemplary scalloped vent seam 600 having a plurality of scalloped vents 606, 608, and 610. The scalloped vents 606-610 are an exemplary embodiment of interior scalloped vents as previously discussed. For example, each of the scalloped vents 606-610 extend toward a wearer of a garment. Stated differently, while the scalloped vents 606-610 extend from a plane defined by a first portion 604 and a second portion 602, they extend inwardly in a direction of a wearer of a garment having the scalloped vents 606-610. To achieve interior scalloped vents, an exterior (e.g., distal) surface of the second portion 602 is affixed, discontinuously, to an interior (e.g., proximal) surface of the first portion 604, such that the second portion 602 has a pre-attached length along a vent edge that is greater than a pre-attached length of the edge to which it will be affixed on the first portion 604.

Embodiments of the present invention include interior scalloped vents, exterior scalloped vents, and/or a combination of both exterior and interior scalloped vents. Additionally, it is contemplated that a first type (i.e., interior, exterior) of scalloped vents are used in a first location of a garment and a different type of scalloped vents are used in a second location of the garment. For example, interior scalloped vents may be used along a first length of a vent seam and exterior scalloped may be used along a second length of the vent seam. This may be implemented to maximize thermal energy dissipation while also maximizing comfort for a wearer (e.g., reducing rubbing of material on the body of a wearer).

Figure 7:
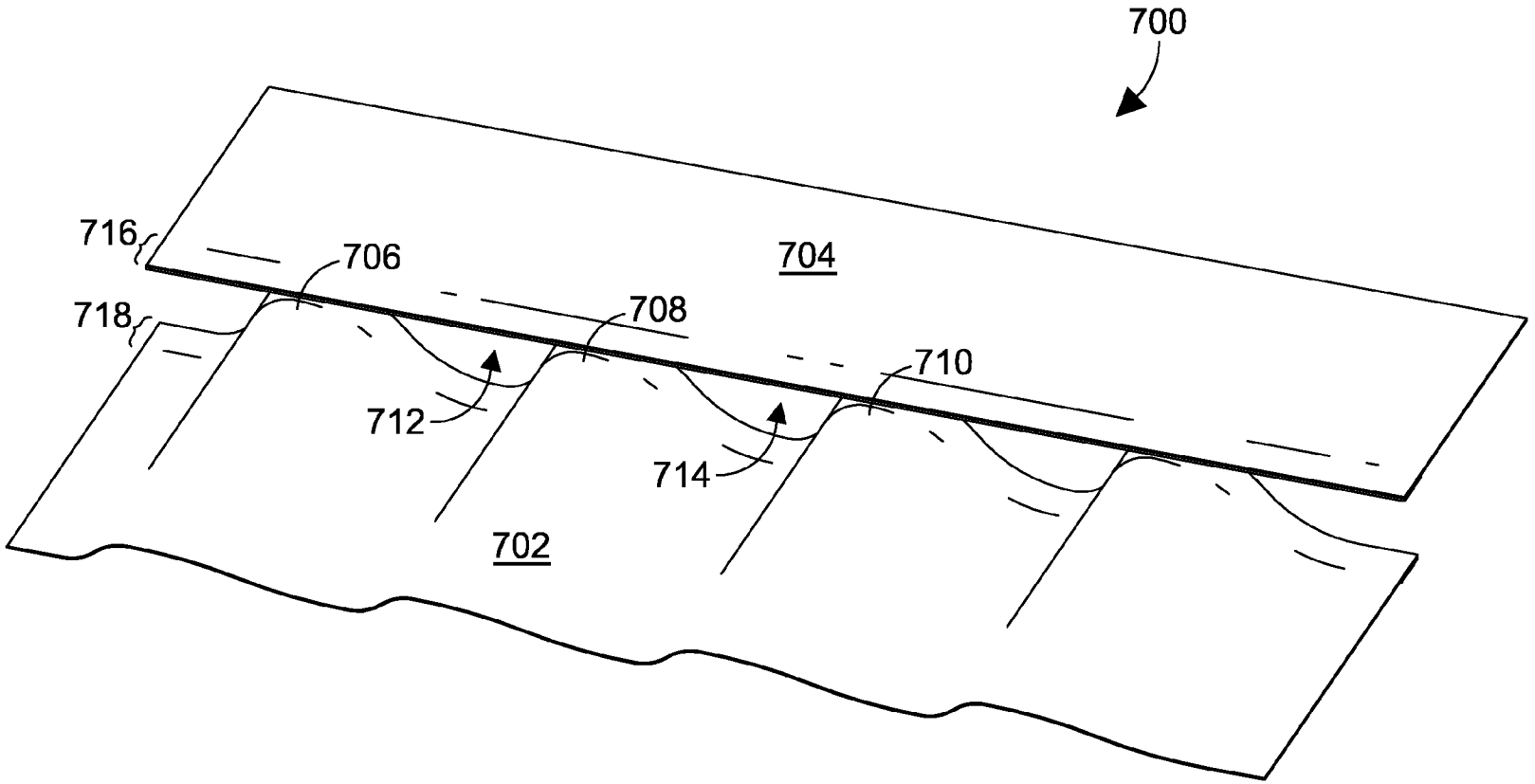
FIG. 7 depicts an exemplary scalloped vent seam in accordance with an embodiment of the present invention.

Turning to FIG. 7 that illustrates a scalloped vent seam 700. The scalloped vent seam 700 is created from a first portion 702 and a second portion 704. The scalloped vent seam 700 incorporates a plurality of scalloped vents having scalloped vent openings. For example, a scalloped vent opening 712 and scalloped vent opening 714 are openings along the scalloped vent seam 700 for allowing air to move from a first surface (e.g., exterior) to a second surface (e.g., interior) when implemented with a garment.

The scalloped vent seam 700 also incorporates a plurality of scalloped vent adhesion portions. As scalloped vent adhesion portion is a portion along a scalloped vent seam in which the first portion 702 is adhered to the second portion 704. Examples of scalloped vent adhesion portions incorporates adhesion portion 706, 708, and 710. In an exemplary embodiment, the adhesion portions 706-710 are approximate to a uniform length along the scalloped vent seam 700. In an additional exemplary embodiment, each of the adhesions portions may have a different length. For example, an embodiment may increase an adhesion portion length in areas where less thermal energy dissipation is desired, where additional strength is desired (e.g., near joins or stress points within a garment), to reduce a dimension in which a scalloped vent extends out from a plane defined by the portions used to create it (e.g., reduce rubbing to a wearer's skin), and/or to change the aesthetics of the garment.

Along this example, it is contemplated that the adhesion portion length decreases as the vent seam progresses from a superior to an anterior location as worn by a wearer of the garment. Stated differently, a vent seam, in an example, has smaller scalloped vents underneath the arms of a wearer and increase in size the closer the vent seam get to a waist of the wearer. The size of the scalloped vents may be changed by changing a length of an adhesion portion. Additionally, scalloped vent size may be changed by apportioning a greater/lesser amount of material between each adhesion portion.

A combination of adhesion portions, in an exemplary embodiment, constitutes a discontinuous adhesion of two portions. For example, the vent seam 700, which incorporates the adhesion portions 706-710, is a discontinuous adhesion of the first portion 702 to the second portion 704. The adhesion of the two panels discontinues at each of the scalloped event opening, such as scalloped vent openings 712 and 714. In an exemplary embodiment, a vent seam is defined to include at least two adhesions portions. Therefore, a vent seam, in this example, incorporates at least one vent opening located between two adhesions portions. Additional embodiments contemplate at least 2, 3, 4, 5, or 6 vent openings along a vent seam. It is understood that any number of vent opening are contemplated greater than or equal to one vent opening.

In an exemplary embodiment, the first portion 702 incorporates a member 718 adhered/attached on a surface proximate to a vent seam edge of the first portion 702 perimeter. The member 718, in an exemplary embodiment, is a rigidity increasing member that provides additional rigidity to the first portion 702 in order to maintain the scalloped vent opening 712 and 714. The member 718 may be a polyurethane film that is heat and/or pressure applied to the surface, either exterior or interior, of the first portion 702. The width and the thickness of the member 718 may be increased or decreased to achieve a desired rigidity. For example, the member 718 may have a width of 8 millimeters to achieve a desired rigidity that allows the first portion 702 to be shaped while still maintaining a level of usability and comfort for a wearer. Additional embodiments of the member 718 include stitching, plastic, metal, fiber, and other boning materials.

In an additional exemplary embodiment, the second portion 704 incorporates a member 716. The member 716 is adhered/attached on a surface (i.e., exterior, interior) of the second portion 704 proximate to a vent seam edge of the perimeter of the second portion 704. The member 716, in an exemplary embodiment, is a stretch reduction member. A stretch reduction member reduces an amount of elasticity that is inherent to the second portion 704 in a direction of the vent seam 700. The member 716 may include a stitching pattern to reduce the elasticity of the second portion 704. Additional embodiments include a plastic, polyurethane tape, metal, additional material, cord, and the like for reducing the elasticity of the second portion 704. Reduction of elasticity of the second portion allows the scalloped vent opening 712 and 714 to maintain a particular size. For example, as air volume flowing through the scalloped vent opening 712 and 714 increases, an amount of pressure exerted on the second portion 704 may also increase resulting in a shrinking of the scalloped vent opening 712 and 714.

Figure 8:
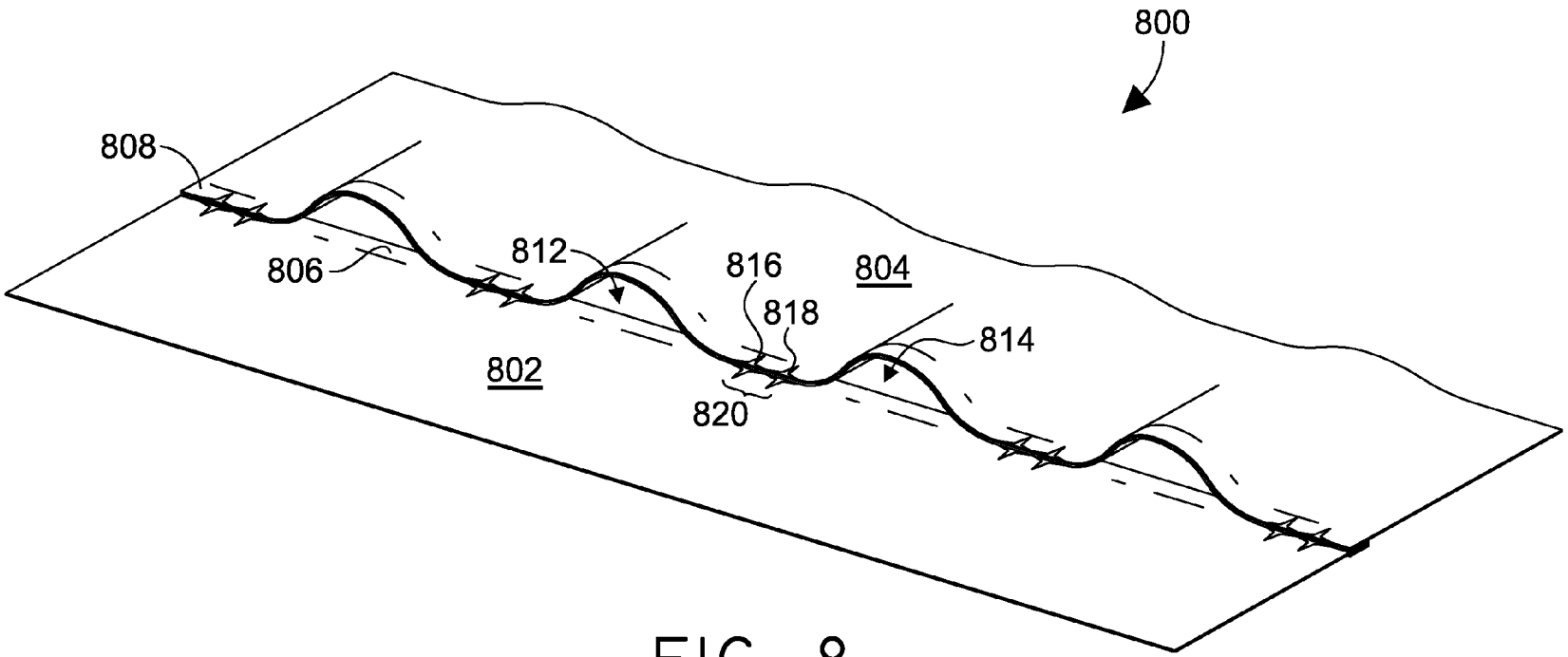
FIG. 8 depicts another exemplary scalloped vent seam having graphical markings in accordance with an embodiment of the present invention.

Turning to FIG. 8 that depicts a vent seam 800 formed from a first portion 802 and a second portion 804. The vent seam 800 incorporates a plurality of graphical markings proximate to vent seam edges of the first portion 802 and the second portion 804. For example, a first graphical marking 816 and a second graphical marking 818 are depicted on the second portion 804. Reciprocating graphical markings are also located on the first portion 802 as graphical markings 820.

In addition to aesthetic purposes, the graphical markings provide registers for affixing the first portion 802 to the second portion 804 at defined locations in order to achieve a series of scalloped vents having a defined size and spacing. Therefore, in an exemplary embodiment, when the graphical marking 816 and 818 are matched to the graphical marking 820, the size of a scalloped vent opening 812 and 814 are affected. Additionally, an adhesion portion between the scalloped vent opening 812 and 814 is also affected based on the location of the graphical marking. For example, the greater the distance between graphical marking 816 and graphical marking 818, the greater the length of an adhesion portion and the potentially smaller size of scalloped vent openings 812 and 814, assuming constant adhesion points before scalloped vent opening 812 and after scalloped vent opening 814.

To properly apportion excess length of the second portion 804 along the vent seam 800, graphical marking are placed on the second portion 804 at defined locations and reciprocating graphical marking are placed on the first portion 802. Because the graphical marking are functional for apportion excess material and identifying points of adhesions, the graphical marking of the second portion 804 do not correspond the graphical markings of the first portion 802 prior to adhesion. Consequently, the spacing, which identifies a scalloped vent opening, between two graphical markings on the second portion 804 is greater than a distance between complimentary graphical markings on the first portion 802.

The vent seam 800, in an exemplary embodiment, incorporates a member 806 for reducing the elasticity of the first portion 802. Additionally, the vent seam 800, in an exemplary embodiment, incorporates a member 808 for increasing the rigidity of the second portion 804 along the vent edge. In an exemplary embodiment, the graphical marking may be incorporated within or printed thereon the member 806 and/or the member 808.

Figure 9:
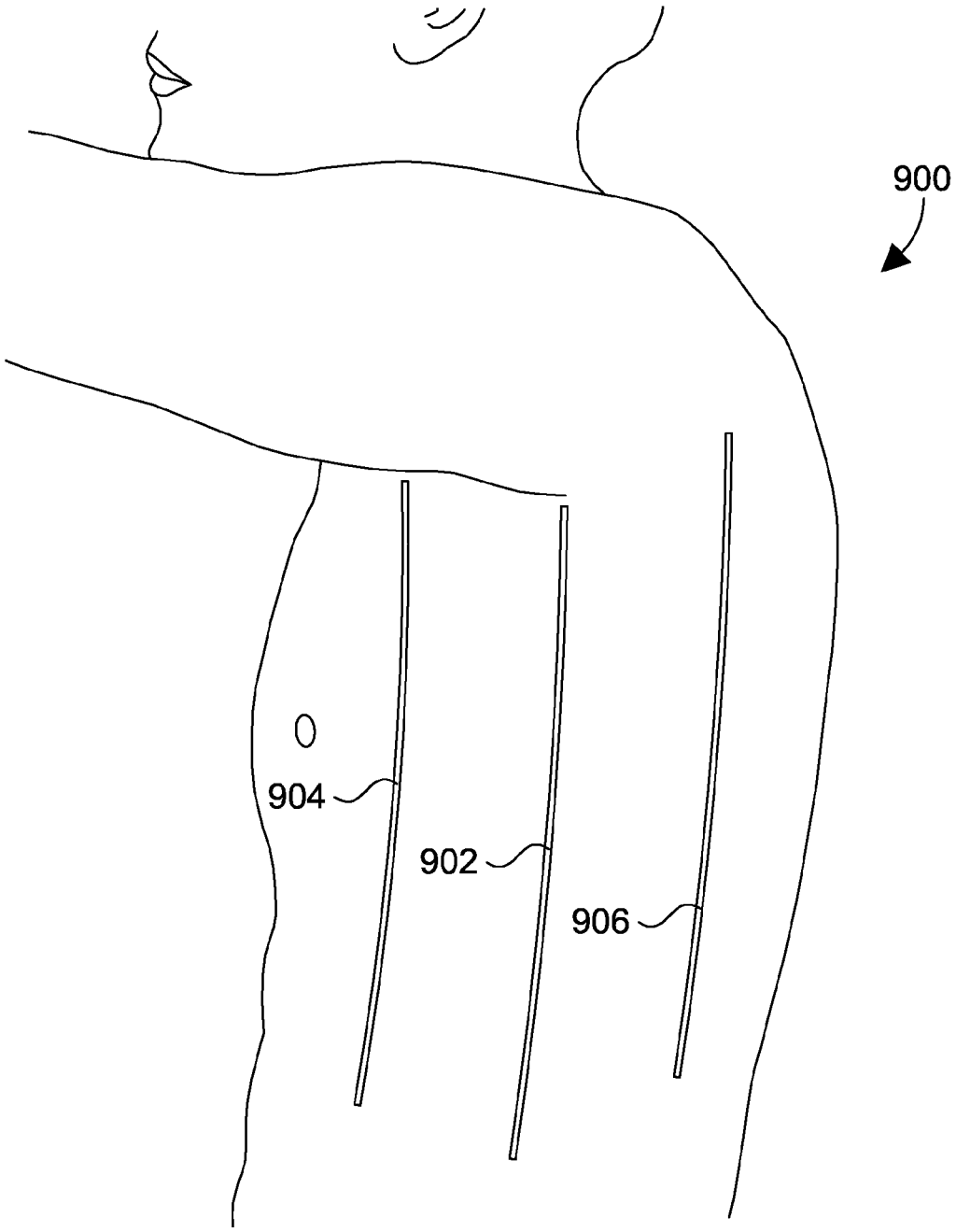
FIG. 9 depicts exemplary axillary lines of a potential wearer of a garment in accordance with an embodiment of the present invention.

Turning to FIG. 9 depicting axillary lines of a potential wearer 900. The wearer 900 incorporates a midaxillary line 902. The midaxillary line 902 is an imaginary line running vertically through the apex of the axilla (i.e., armpit). Approximately parallel to the midaxillary line 902, an anterior axillary line 904 is illustrated. The anterior axillary line 904 passes through an anterior axillary skinfold of the wearer. Additionally, approximately parallel to the midaxillary line 902, a posterior axillary line 908 is illustrated. The posterior axillary line 908 passes through a posterior axillary skinfold of the wearer. In an exemplary embodiment, the orientation and path of a vent seam are defined based on at least one of the midaxillary line 902, the anterior axillary line 904, and/or the posterior axillary line 908 to achieve thermal energy dissipation that is maximized to air volume intake, reduce rubbing/chaffing to a wearer, and/or increase thermal energy dissipation.

The invention claimed is:

1. A garment, comprising:

a first garment portion having an exterior surface, an opposite interior surface, and a perimeter defined by at least a first side;

a second garment portion having an exterior surface, an opposite interior surface, and a perimeter defined by at least a vent side;

wherein the first garment portion and the second garment portion are permanently and discontinuously affixed to each other at defined intervals along the first side and the vent side creating a vent seam having a plurality of scalloped vents for directing air towards a body of a wearer; and a third garment portion, wherein the first garment portion is configured to be located at an anterior location of a wearer of the garment when in an as-worn position, the second garment portion is configured to be located at a lateral location of the wearer when in the as-worn position, and the third garment portion is configured to be located at a posterior location of the wearer when in the as-worn position.

2. The garment of claim 1, wherein the scalloped vents result from puckering of either the first garment portion or the second garment portions along the vent seam.

3. The garment of claim 1 further comprising:

a first sequence of graphical markings at specified locations along a surface of the first garment portion adjacent to the first side; and a second sequence of graphical markings at specified locations along a surface of the second garment portion adjacent to the vent side;

the first sequence of graphical markings and the second sequence of graphical markings, when used in combination, align the first garment portion and the second garment portion to create the plurality of scalloped vents.

4. The garment of claim 3, wherein the first sequence of graphical marking and the second sequence of graphical markings identify the defined intervals for permanently and discontinuously affixing the first garment portion and the second garment portion.

5. The garment of claim 3, wherein at least one of the first sequence of graphical markings or the second sequence of graphical marking is affixed to the garment as a heat bonded element.

6. The garment of claim 5, wherein the heat bonded element provides rigidity that assists in maintaining the shape of the plurality of scalloped vents.

7. The garment of claim 5, wherein the heat bonded element reduces stretching properties of the garment proximate to the location of affixation of the heat bonded element.

8. The garment of claim 1, wherein prior to permanently and discontinuously affixing the first garment portion and the second garment portion, the first side is at least 110% the length of the vent side between a first point of affixation and a last point of affixation of the first garment portion and the second garment portion that defines the vent seam.

9. The garment of claim 1, wherein prior to permanently and discontinuously affixing the first garment portion and the second garment portion, the vent side is at least 110% the length of the first side between a first point of affixation and a last point of affixation of the first garment portion and the second garment portion that defines the vent seam.

10. A garment, comprising:

an anterior panel having an exterior surface, an opposite interior surface, and a perimeter including an anterior vent edge;

a lateral panel having an exterior surface, an opposite interior surface, and a perimeter including a lateral vent edge;

a scallop vent seam defined by affixing, at discontinuous points, the anterior panel and the lateral panel together proximate to the anterior vent edge and the lateral vent edge, wherein the scallop vent seam provides a plurality of scalloped vents that extend away from a plane defined by the anterior panel and the lateral panel; and a posterior panel, wherein the anterior panel is configured to be located at an anterior location of a wearer of the garment when in an as-worn position, the lateral panel is configured to be located at a lateral location of the wearer when in the as-worn position, and the posterior panel is configured to be located at a posterior location of the wearer when in the as-worn position.

11. The garment of claim 10, wherein the scalloped vent seam is approximately parallel with a midaxillary line of a wearer of the garment.

12. The garment of claim 10, wherein the scalloped vent seam extends from a first location to a second location;

the first location is at an anatomically superior point to the second location when worn by a wearer of the garment;

the first location is between a posterior axillary line and an anterior axillary line when worn by the wearer of the garment; and the second location, while anatomically inferior to the first location, is anterior to the first point when worn by the wearer.

13. The garment of claim 10, wherein the posterior panel incorporates a plurality of voids for allowing air directed by the plurality of scalloped vents to exit an interior of the garment.

14. The garment of claim 13, wherein the posterior panel is constructed of a mesh material.

15. The garment of claim 10, wherein the plurality of scalloped vents are configured to extend inward towards a wearer of the garment when in the as-worn position.

16. The garment of claim 10, wherein the plurality of scalloped vents are configured to extend outward away from a wearer of the garment when in the as-worn position.

17. The garment of claim 10, wherein a first of the plurality of scalloped vents is of a different size than a second of the plurality of scalloped vents.

18. The garment of claim 17, wherein the different size is measured by a volume of air that may pass through the first scalloped vent relative to the second scalloped vent.

19. A thermal energy moderating garment, comprising:

a front panel comprised of an exterior surface, an interior surface, and perimeter defined by at least a front right lateral edge and a front left lateral edge;

a back panel comprised of an exterior surface, an interior surface, and a perimeter defined by at least a back right lateral edge and a back left lateral edge, wherein the back panel incorporates a plurality of openings through the complimentary exterior surface and the interior surface;

a right lateral panel comprised of an exterior surface, an interior surface, and a perimeter defined by at least a right vent edge and a right back edge;

a left lateral panel comprised of an exterior surface, an interior surface, and a perimeter defined by at least a left vent edge and a left back edge;

wherein the front panel, proximate to the front right lateral edge, is joined at a series of discontinuous locations to the right lateral panel, proximate to the right vent edge, resulting in a right scalloped vent seam, the right scalloped vent seam is comprised of a plurality of scalloped vents configured for extending away from a body of a wearer of the thermal energy moderating garment when in an as-worn position;

wherein the front panel, proximate to the front left lateral edge, is joined at a series of discontinuous locations to the left lateral panel, proximate to the left vent edge, resulting in a left scalloped vent seam, the left scalloped vent seam is comprised of a plurality of scalloped vents configured for extending away from the body of the wearer of the thermal energy moderating garment when in the as-worn position;

wherein the back panel, proximate to the back right lateral edge, is joined to the right lateral panel, proximate to the right back edge; and wherein the back panel, proximate to the back left lateral edge, is joined to the left lateral panel, proximate to the left back edge.

* * * * *